US009534833B2

(12) United States Patent
Choi et al.

(10) Patent No.: US 9,534,833 B2
(45) Date of Patent: Jan. 3, 2017

(54) BASKET FOR REFRIGERATOR

(71) Applicant: LG ELECTRONICS INC., Seoul (KR)

(72) Inventors: Daejin Choi, Seoul (KR); Bonggun Jung, Seoul (KR); Tackwon Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 54 days.

(21) Appl. No.: 14/479,925

(22) Filed: Sep. 8, 2014

(65) Prior Publication Data

US 2015/0069066 A1 Mar. 12, 2015

(30) Foreign Application Priority Data

Sep. 9, 2013 (KR) ..... 10-2013-0107700
Nov. 29, 2013 (KR) ..... 10-2013-0147539

(51) Int. Cl.
*F25D 25/02* (2006.01)

(52) U.S. Cl.
CPC ..... *F25D 25/022* (2013.01)

(58) Field of Classification Search
CPC ..... F25D 25/022
USPC ..... 220/529, 530, 532, 533, 534, 535, 543, 220/544, 545, 549; 312/401, 404
See application file for complete search history.

(56) References Cited

U.S. PATENT DOCUMENTS 5,082,139 A * 1/1992 Quam ..... B65F 1/0046 220/530
8,590,992 B2 * 11/2013 Lim ..... A47B 88/20 312/348.3
2003/0052583 A1 * 3/2003 Son ..... A47B 88/20 312/404
2006/0260353 A1 * 11/2006 Uihlein ..... A47B 88/20 62/441
2009/0026906 A1 * 1/2009 Kim ..... F25D 25/025 312/401
2013/0099651 A1 * 4/2013 Hwang ..... F25D 25/025 312/404

FOREIGN PATENT DOCUMENTS

KR 10-2004-0082702 A 9/2004
KR 10-2011-0001699 A 1/2011

* cited by examiner

*Primary Examiner* — Robert J Hicks
*Assistant Examiner* — Kareen Thomas
(74) *Attorney, Agent, or Firm* — Ked & Associates, LLP

(57) ABSTRACT

Provided is a basket for a refrigerator. The basket for a refrigerator, which defines a receiving space for a food includes a partition member disposed in the basket to partition an inner space of the basket, a pair of guide slots respectively defined in both side surfaces of the basket and opened along a moving direction of the partition member, the pair of guide slots guiding movement of the partition member, and a guide member disposed outside the basket, the guide member being coupled to the partition member through the guide slots. The partition member partitioning the inside of the basket may smoothly move to improve manipulation feeling and convenience in use.

17 Claims, 6 Drawing Sheets

BASKET FOR REFRIGERATOR

CROSS-REFERENCE TO RELATED APPLICATION(S)

This application claims priority under 35 U.S.C. §119 to Korean Application Nos. 10-2013-0107700 filed on Sep. 9, 2013 and 10-2013-0147539 filed on Nov. 29, 2013, whose entire disclosures are hereby incorporated by reference.

BACKGROUND

1. Field

The present disclosure relates to a basket for a refrigerator.

2. Background

Baskets for refrigerators are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to the embodiments of the present disclosure, examples of which are illustrated in the accompanying drawings. The technical scope of the embodiments will fall within the scope of this disclosure, and addition, deletion and modification of components or parts are possible within the scope of the embodiments.

That is, for convenience of description, although a bottom freezer type refrigerator is described as an example in the embodiment, the present disclosure is not limited thereto. For example, features according to the embodiments may be applied to all types of refrigerators including the basket.

In general, a refrigerator is a home appliance that provides a low-temperature storage space, which is opened or closed by a door, to store foods at a low temperature. For this, the refrigerator cools the inside of the storage space by using cool air generated by being heat-exchanged with a refrigerant circulated into a refrigeration cycle to store the foods in an optimum state.

The size of the refrigerator tends to increase more and more and multi-functions are provided to the refrigerator as dietary life changes and pursues high quality, and accordingly, refrigerators of various structures with consideration of user convenience and energy efficiency are brought to the market. Also, inner receiving structures are being variously developed for user's convenience and storage efficiency.

For example, the refrigerator has a structure in which a basket is mounted on a withdrawable drawer-type door to receive foods. The door basket may be exposed to a top surface of the door when the door is withdrawn, and thus, a user may receive foods into the door basket.

In characteristics in above-described the spatial structure, it is necessary to provide a partition member for partitioning the basket in the basket. The user may adjust the inner space of the basket by moving the partition member.

A basket assembly for a refrigerator may include a partition part for partitioning the inside of a basket and a fixing part having a hook shape and coupled to a flange of the basket to allow the partition part to move along the flange of the basket in left and right directions, thereby adjusting a ratio of space that is partitioned within the basket.

A drawer type storage box structure of a refrigerator, in which a separation plate for horizontally portioning a receiving space is movably disposed along an upper edge of a storage box having a basket shape to manipulate the separation plate, thereby setting a ratio of inner space of the storage box.

In the basket having the above-described structures, when the partition part or the separation plate horizontally moves by the user, the partition part or the separation plate may not smoothly move to deteriorate manipulation feeling and cause inconvenience in use. Accordingly, provided is a basket for a refrigerator that overcomes these and other disadvantages.

Figure 1:
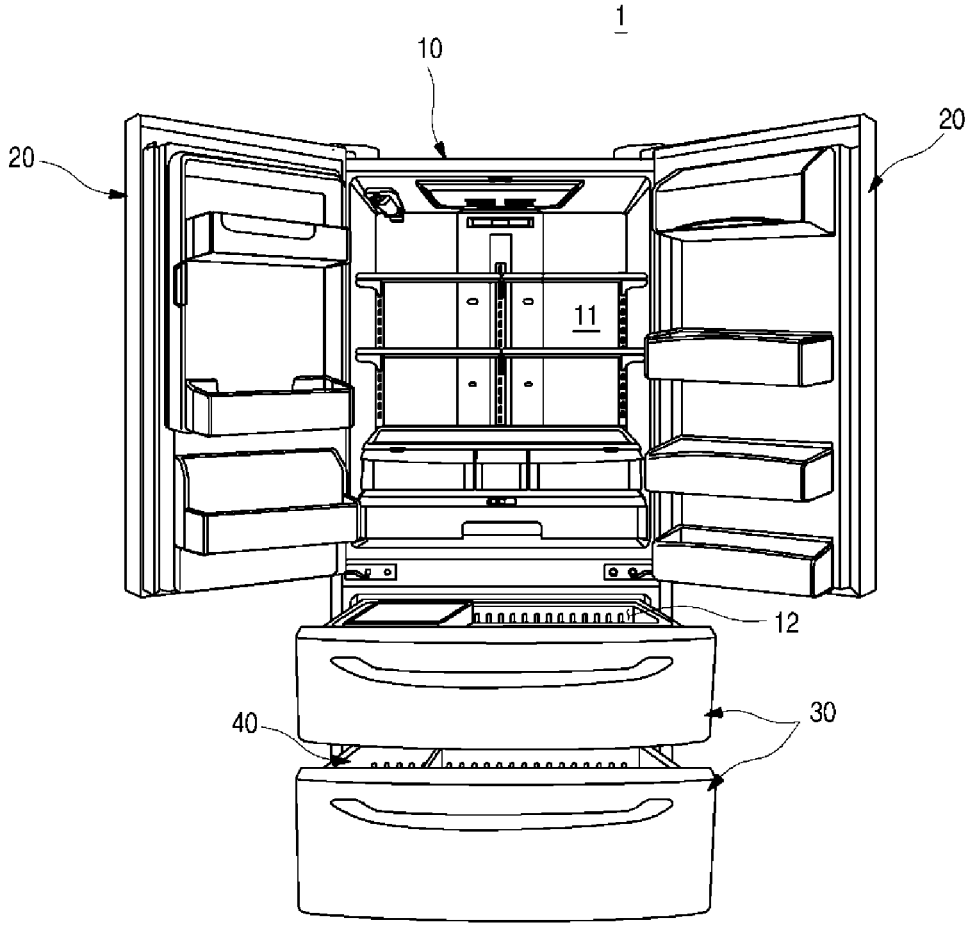
FIG. 1 is a view of a refrigerator with a door opened according to an embodiment.

FIG. 1 is a view of a refrigerator with a door opened according to an embodiment. A refrigerator 1 according to an embodiment includes a main body 10 defining a storage space therein and doors 20 and 30 that are rotatably mounted on the main body 10. Here, an exterior of the refrigerator 1 may be defined by the doors 20 and 30.

The inside of the main body 10 may be vertically partitioned to define a refrigerating compartment 11 at an upper side and a freezing compartment 12 at a lower side. Also, the doors for respectively opening or closing the refrigerating compartment 11 and the freezing compartment 12 are disposed on the main body 10.

The doors include a rotation door rotatably mounted on the main body 10 and a sliding door 30 slidably and withdrawably mounted on the main body 10. The rotation door 20 is provided in a pair on left and right sides. The pair of rotation doors 20 may rotate to block one refrigerating compartment.

Also, the sliding door 30 (hereinafter, referred to as a door) may have a drawer structure. In addition, a basket 40 defining a receiving space is mounted on the door 30. The basket 40 may be integrated with the door 30. Alternatively, the basket 40 may be attached or detached on the door 30 or a frame provided on the door 30.

The door 30 may be provided in plurality, and thus the plurality of doors 30 may be vertically disposed. Here, a space for accommodating the doors 30 may be partitioned to maintain the partitioned spaces at temperatures different from each other. For example, an upper space may be used as the refrigerating compartment, and the lower space may be used as the freezing compartment. Alternatively, all of the two spaces may be used as the freezing compartment. Here, the two spaces may be maintained at temperatures different from each other.

Figure 2:
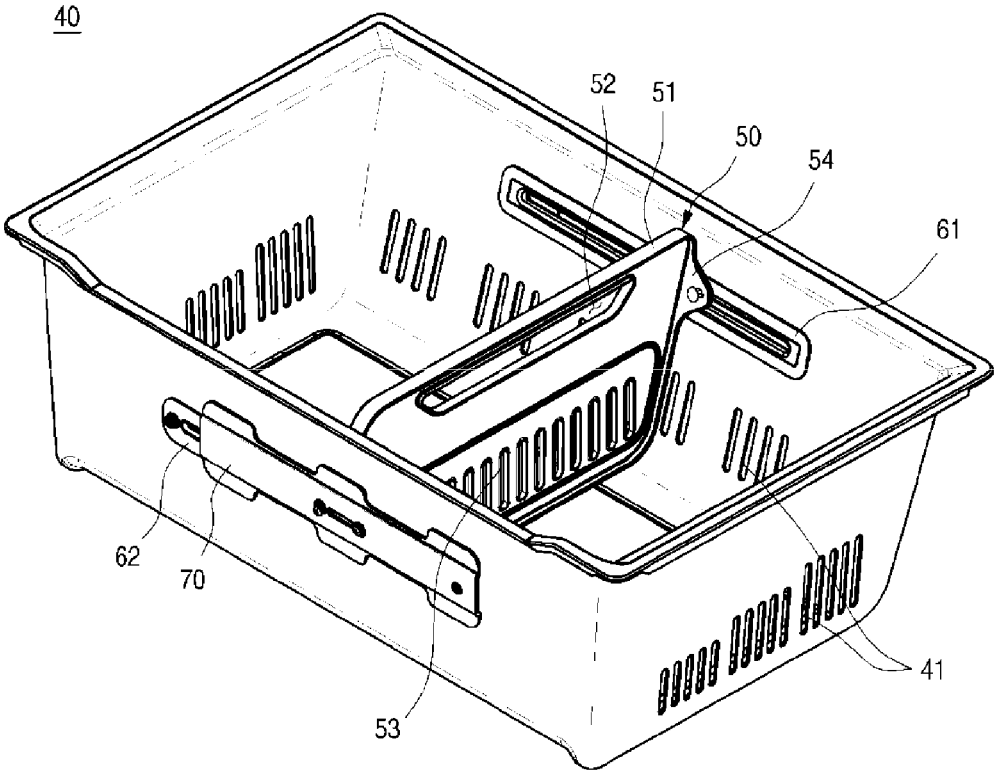
FIG. 2 is a perspective view of a basket according to an embodiment.
Figure 3:
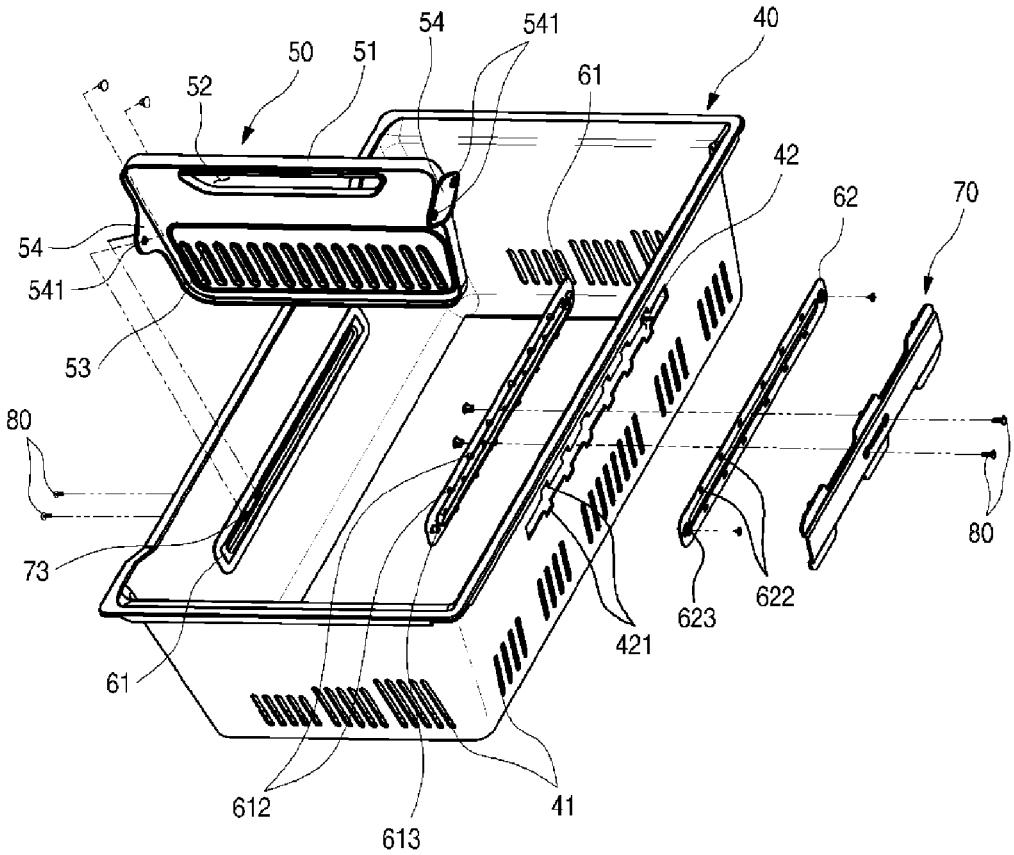
FIG. 3 is an exploded perspective view of the basket.

FIG. 2 is a perspective view of a basket according to an embodiment. FIG. 3 is an exploded perspective view of the basket. The basket 40 may be formed of a plastic material. Also, the basket 40 may have an opened top surface to provide a space for receiving foods therein. Also, a plurality of vents 41 may be defined in the basket 40 so that cool air is introduced into the basket 40 to store the received foods in the more fresh state.

A partition member 50 for bisectionally partitioning the basket 40 is disposed in the basket 40. The partition member 50 has a plate shape. Also, the partition member 50 may have a shape corresponding so that the partition member 50 contacts an inner surface of the basket 40.

In detail, the partition member may have a plate shape, and a flange 51 having a predetermined thickness may be disposed on a circumference of the partition member 50. The flange 51 may surface-contact the basket 40. Also, the flange 51 may have a predetermined width so that the partition member 50 is stably mounted or shifted.

Also, a handle hole 52 to be grasped by a user is defined in an upper portion of the partition member 50. The handle hole 52 may pass through the upper portion of the partition member 50. Also, the handle hole 52 may be lengthily defined in a transverse direction.

A plurality of vent holes 53 may be further defined in a lower portion of the partition member 50. The cool air may flow between the inner spaces of the basket 40, which is partitioned by the partition member 50, through the vent holes 53. Each of the vent holes 53 may be lengthily defined in a vertical direction. Alternatively, the plurality of vent holes 53 may be successively defined.

Also, a fixing part 54 may be disposed on each of both side ends of the partition member 50. The fixing part 54 may be a flange. For example, the fixing part 54 may be integrated with the flange 51. Here, the fixing part 54 may further protrude outward from the flange 51. That is, the fixing part 54 may further protrude toward each of both sides with respect to the flange 51. A coupling hole 541 may be defined in the fixing part 54 so that the fixing part 54 is coupled to the guide member 70 by a coupling member 80 that will be described later. The fixing part 54 may be vertically disposed at heights different from each other on each of both side ends of the partition member 50. Thus, when the partition member 50 moves in left and right directions, the partition member 50 may be stably manipulated without causing a moment.

A guide slot 42 may be defined in each of both sides of the basket 40 facing each other. The guide slot 42 may guide the movement of the partition member 50. The guide slot 42 may be lengthily defined in a horizontal direction at a height corresponding to the position of the fixing part 54 to provide a path along which the partition member 50 moves.

The guide slot 42 may have a sufficient size so that a portion of the guide member 70 that will be described later in detail is inserted. A recess part 421 recessed from each of upper and lower portions of the guide slot 42 is defined. A coupling protrusion 612 may be disposed in the recess part 421 when a pair of cover members 60 mounted on the basket 40 are coupled to each other. The recess part 421 may be provided in plurality at positions corresponding to the coupling protrusions 612.

The guide slots 42 may be defined to face each other. Also, the guide slots 42 may have the same structure and shape. However, the guide slots 42 may be defined at heights different from each other according to the position of the fixing part 54.

Figure 4:
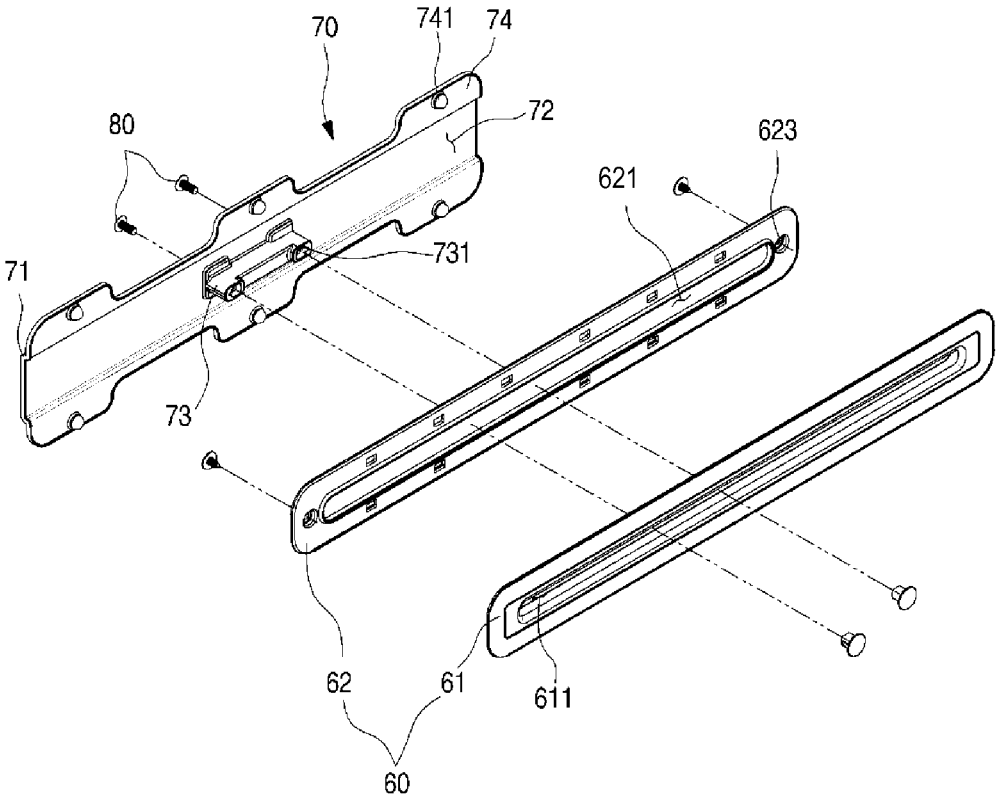
FIG. 4 is an exploded perspective view of a guide member and a cover member according to an embodiment.
Figure 5:
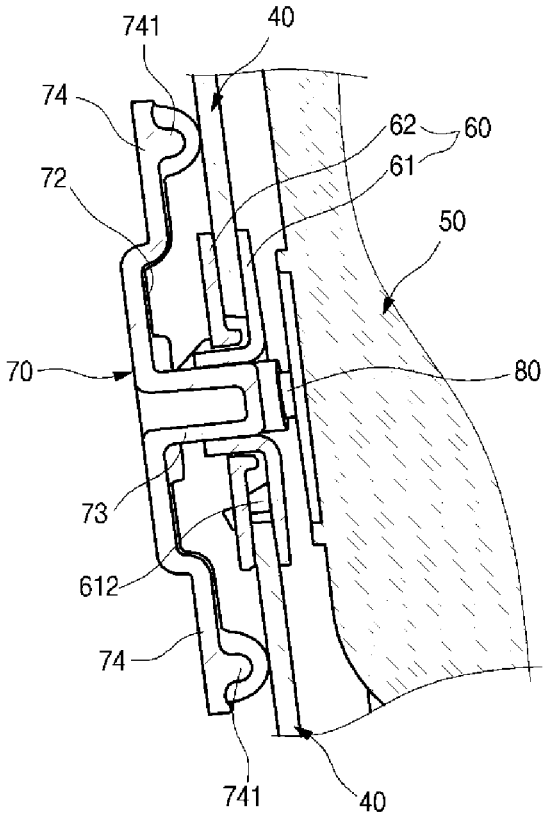
FIG. 5 is a cross-sectional view taken along line 5-5' of FIG. 2.

FIG. 4 is an exploded perspective view of a guide member and a cover member according to an embodiment. FIG. 5 is a sectional view taken along line 5-5' of FIG. 2. The cover member and the guide member will be described in more detail. The cover member 60 is disposed on each of both sides of the basket 40 and mounted in the guide slot 42. The cover members 60 may also be referred to as brackets. One of the two cover members 60 includes an inner cover 61 (or inner bracket) disposed on an inner surface of the basket 40 and an outer cover 62 (or outer bracket) disposed on an outer surface of the basket 40, which are provided in a pair and coupled to each other.

The inner cover 61 and the outer cover 62 may have slots 611 and 62 having the same shape, respectively. Also, each of the slots 611 and 621 may have a size corresponding to that of the guide slot 42 so that the guide member 70 may move along the slots 611 and 621.

Also, a plurality of coupling protrusions 612 and coupling grooves 622 are provided along circumferences of the slots 611 and 621, respectively. In detail, the plurality of coupling protrusions 612 may protrude from the inner cover 61, and the coupling grooves 622 in which the coupling protrusions 612 are inserted and coupled may be defined in the outer cover 62. The coupling protrusion 612 and the coupling groove 622 may be coupled to each other through a press-fit or hook manner. Thus, the coupling protrusion 612 and the coupling groove 622 may be firmly fixed to each other.

Also, the coupling protrusion 612 may be disposed at a position corresponding to that of the recess part defined in the guide slot 42 of the basket. Thus, when the inner cover 61 and the outer cover 62 are coupled to each other, the basket 40 may be disposed between the inner cover 61 and the outer cover 62. That is, when the inner cover 61 and the outer cover 62 are coupled to each other, the basket 40 may be closely attached to the inner cover 61 and the outer cover 62 without interfering. Thus, since the inner cover 61 and the outer cover 62 are coupled to each other, the fixed and mounted state of the inner cover 61 and the outer cover 62 on the basket 40 may be maintained.

Also, a protruding coupling part 613 and a recessed coupling groove 623 may be further provided on/in both ends of the inner cover 61 and the outer cover 62. The coupling part 613 may pass through the basket 40 and then be coupled to the coupling groove 623. Thus, the inner cover 61 and the outer cover 62 may be more firmly fixed to each other on the basket 40.

The guide member 70 may be disposed outside the basket 40. The guide member 70 may be coupled to the partition member 50 by the coupling member 80 such as a screw or rivet to move together with the partition member 50 when the partition member 50 moves. Here, the guide member 70 may move along the slots 611 and 621 defined in the cover member 60.

In detail, the guide member 70 includes a guide body 71 having a plate shape and a protrusion 73 protruding from a central portion of the guide body 71. The protrusion 73 may be referred to as a mounting part. Here, the mounting part 73 may be inserted into the slots 611 and 621 of the cover member 60 and then be coupled to the partition member 50.

An accommodation part 72 of which a central portion is recessed in a longitudinal direction is defined in the guide body 71. The outer cover 62 mounted on the basket 40 may be accommodated into the accommodation part 72. Thus, when the guide member 70 moves in the left and right directions, the outer cover 62 may relatively move in the left and right directions within the accommodation part 72.

Also, the mounting part 73 may protrude from a central portion of the accommodation part 72. In addition, the mounting part 73 may pass through the slots 611 and 621 to extend by a sufficient length so that the mount part 73 is connected to the fixing part 54 of the partition member 50. The mounting part 73 may have a predetermined length and width so that the mounting part 73 is inserted into the slots 611 and 621. Also, the mounting part 73 may slidably move along the slots 611 and 621. Also, a screw hole 731 is defined in each of both side ends of the mounting part 73. The screw holes 731 may be spaced a predetermined distance from each other, and the coupling member 80 may be coupled to the screw hole 731. The partition member 50 and the guide member 70 may be coupled to each other through the coupling of the coupling member 80. Also, the partition member 50 and the guide member 70 may slidably move along the slots 611 and 621.

A stepped part 74 may be disposed outside the accommodation part 72. The stepped part 74 may be bent so that the stepped part 74 is stepped at upper and lower ends of the accommodation part 72. Also, the stepped part 74 may protrude somewhat in the protruding direction of the mounting part 73.

The stepped part 74 may be provided in plurality. The plurality of stepped parts 74 may be spaced a predetermined distance from each other. A contact protrusion 741 may be disposed on the stepped part 74. The contact protrusion 741 may have a rounded end. When the guide member 70 is mounted, the contact protrusion 741 may contact the outer surface of the basket 40.

Here, the contact protrusion 741 may point-contact the outer surface of the basket 40. Thus, the guide member 70 may slidably move in a state where friction between the guide member 70 and the outer surface of the basket 40 is minimized. The contact protrusion 741 may be provided in plurality. Here, the plurality of contact protrusions 741 may be spaced a predetermined distance from each other, and thus, the basket 40 may be stably supported by the contact protrusions 741. When the partition member 50 moves, the contact protrusions 741 may uniformly disperse a force to the outer surface of the basket 40 to allow the partition member 50 and the guide member 70 to stably move.

The end of the contact protrusion 741 may have various shapes in addition to the rounded shape. Alternatively, the contact protrusion 741 may have a structure such as a ball bearing so that the partition member 50 and the guide member 70 more smoothly move.

Hereinafter, an operation of the basket for the refrigerator including the above-described constitutions according to an embodiment will be described in detail.

Figure 6:
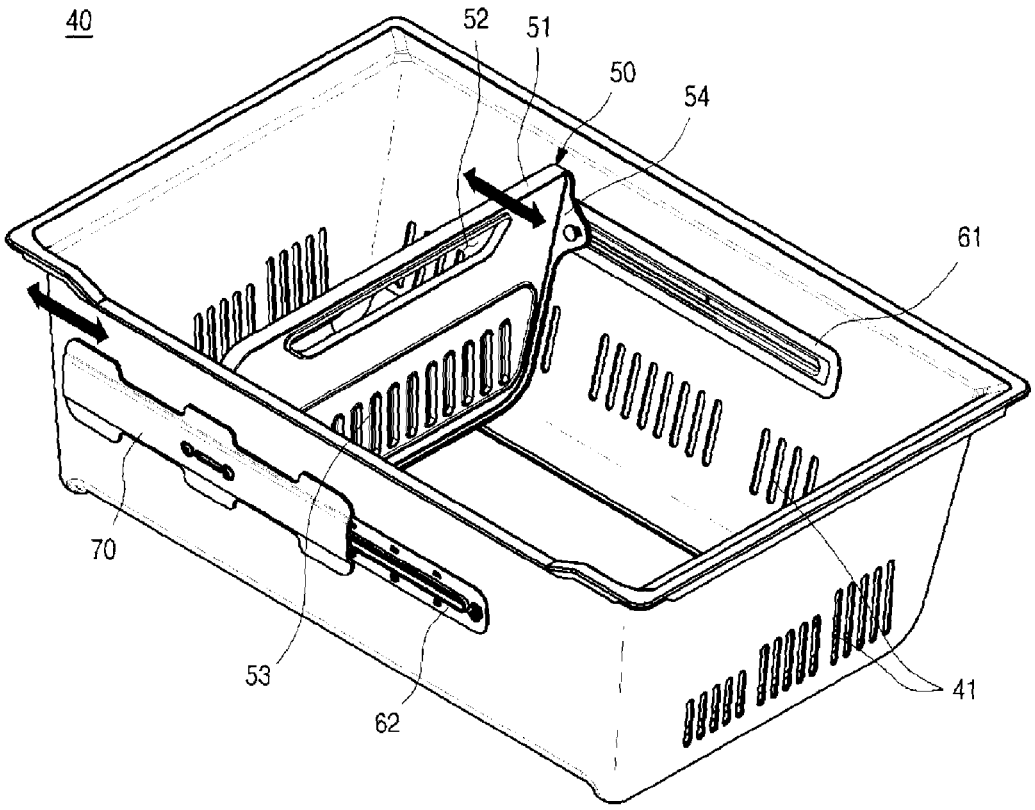
FIG. 6 is a view illustrating a state in which a partition member moves in a basket assembly.

FIG. 6 is a view illustrating a state in which a partition member moves in a basket assembly. The basket 40 may be exposed to the outside by the insertion or withdrawal of the door 30. Here, foods may be received into the basket 40 through the opened top surface of the basket 40.

Here, the inner space of the basket 40 may be adjusted according to a ratio of the spaces partitioned by the user. For this, the user may move the partition member 50 in the left and right directions to adjust the inner space of the basket 40. In detail, the user may move the partition member 50 in the left and right directions in the state where the user inserts a hand thereof into the handle hole 52 and then grasps the upper end of the partition member 50.

When the partition member 50 moves in the left and right directions, the partition member 50 may move in the left and right directions together with the guide member 70 connected to the partition member 50. Here, the fixing parts 54 disposed on both ends of the partition member 50 may be disposed at heights different from each other. Thus, the partition member 50 may be supported on two points by the fixing parts 54 disposed at heights different from each other. Thus, the partition member 50 may be smoothly slid without rotating by the moment.

Also, the guide member 70 may move along the slots 611 and 621 of the cover member 60. Also, the contact protrusion 741 of the guide member 70 may support the guide member 70 to allow the guide member 70 to stably move in the state where the contact protrusion 741 contacts the outer surface of the basket 40.

Particularly, the guide member 70 coupled to each of both sides of the partition member 50 may move in the state where the guide member 70 contacts both sides of the basket 40. Thus, the partition member 50 may slidably move in the stable state without being vibrated.

In the basket for the refrigerator according to the embodiment, when the partition member moves by the user, the partition member may move together with the guide member. Also, the guide member may lengthily extend in the moving direction of the partition member and be in contact with an outer surface of the basket. Thus, when the partition member moves, tilting of the partition member may be prevented to allow the partition member to more stably move.

Thus, the partition member may more smoothly move without interfering or being hooked. Therefore, the manipulation feeling may be improved, and also the user's convenience in use may be improved.

As broadly described and embodied herein, a basket for a refrigerator, which defines a receiving space for a food includes: a partition member disposed in the basket to partition an inner space of the basket; a pair of guide slots respectively defined in both side surfaces of the basket and opened along a moving direction of the partition member, the pair of guide slots guiding movement of the partition member; and a guide member disposed outside the basket, the guide member being coupled to the partition member through the guide slots.

The guide member may move together with the partition member. A pair of cover members each of which has a slot through which the guide member passes may be disposed inside and outside the guide slots. The guide member may include: a guide body extending in a longitudinal direction of each of the guide slots; a mounting part protruding from the guide body to pass through the guide slots, the mounting part being coupled to the partition member; and a plurality of contact protrusions protruding from one side of the guide body to contact an outer surface of the basket.

Each of the contact protrusions may have a rounded shape and point-contacts the outer surface of the basket. The plurality of contact protrusions may contact the outer surface of the basket corresponding to the outside of the guide slots and be vertically spaced a predetermined distance from each other. The mounting part may extend in a transverse direction, and the pair of coupling members may be coupled to both ends of the mounting part.

A plurality of contact protrusions that protrude to contact the outer surface of the basket may be disposed on an inner surface of the guide member. The pair of guide slots may be defined at heights different from each other. The guide member may lengthily extend in the moving direction of the partition member. Moreover, the partition member may be disposed in a direction crossing the guide slots.

The basket for the refrigerator may be mounted on a door that is opened or closed while slidably inserted into or withdrawn from a storage space of the refrigerator. A handle hole may be defined in an upper portion of the partition member. A flange laterally extending to contact an inner surface of the basket may be disposed on a circumference of the partition member. Moreover, a fixing part laterally extending and coupled to the guide member may be further disposed each of both ends of the partition member.

An inner cover and an outer cover may be coupled to the inside and the outside of each of the guide slots, respectively, and a slot having a length corresponding to the guide slot may be defined in each of the inner cover and the outer cover to allow a portion of the guide member to successively pass through the guide slot and the slot. An accommodation part recessed to accommodate the outer cover may be defined in the guide member.

Contact protrusions arranged along upper and lower portions of the outer cover and protruding to contact the outer surface of the basket, thereby allowing an inner surface of the guide member to be spaced apart from the outer surface of the basket may be disposed on the inner surface of the guide member. A coupling protrusion, which passes through a recess part defined in each of upper and lower ends of each of the guide slots, and a coupling groove, which are coupled to each other, may be further provided on/in the inner case and the outer case, respectively.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A basket for a refrigerator comprising:

a basket body having a receiving space therein for storing food, the receiving space formed by a plurality of walls including a first wall and a second wall facing the first wall;

a partition member disposed in the receiving space to partition the receiving space of the basket body;

a pair of guide slots respectively defined in the first and second walls of the basket body and formed lengthwise in a direction in which the partition is movable, the pair of guide slots configured to guide movement of the partition member;

a pair of guide members disposed on respective outer surfaces of the first and second walls, the guide members being coupled to the partition through the guide slots, to move as one body with the partition member; and a pair of cover members disposed at each of the guide slots, wherein each of the pair of cover members includes:

an inner bracket provided on an inner surface of the first or second wall; and an outer bracket provided on the outer surface of the first or second wall.

2. The basket according to claim 1, wherein each of the guide members include a guide body that extends in a longitudinal direction of each of the guide slots, a protrusion that protrudes from the guide body to pass through the guide slots, the protrusion being coupled to the partition, and a plurality of contact protrusions that protrude from one side of the guide body to contact an outer surface of the basket body.

3. The basket according to claim 2, wherein each of the contact protrusions has a rounded shape at a contact point with the outer surface of the basket body.

4. The basket according to claim 2, wherein the plurality of contact protrusions contact the outer surface of the basket body corresponding to each of the guide slots, at least one contact protrusion being vertically spaced a predetermined distance from another contact protrusion.

5. The basket according to claim 2, wherein the protrusion provided through the guide slots extends in a transverse direction through a corresponding slot, and one or more coupling members are coupled to a distal end of the protrusion.

6. The basket according to claim 1, wherein a handle hole is defined in an upper portion of the partition member.

7. The basket according to claim 5, wherein the partition includes a flange provided around an outer edge of the partition member, the flange to contact an inner surface of the basket body.

8. The basket according to claim 7, wherein the partition member includes an additional flange that further extends from the flange in a moving direction of the partition member to face an inner surface of the basket body and configured to be fixed to the protrusion of the guide member by the one or more coupling members.

9. The basket according to claim 1, wherein a slot having a length corresponding to the guide slot is defined in each of the inner bracket and the outer bracket to allow a portion of the guide member to pass therethrough.

10. The basket according to claim 9, wherein the guide member includes a recess to accommodate the outer bracket.

11. The basket according to claim 9, wherein contact protrusions are arranged along upper and lower portions of the guide member and protrudes to contact the outer surface of the basket body such that the guide member is spaced a distance from a respective wall of the basket body.

12. The basket according to claim 9, wherein the inner bracket includes one or more coupling protrusions which are formed along upper and lower sides of the slot thereof, wherein the outer bracket includes one or more coupling grooves to which the one or more coupling protrusions are coupled, and wherein the one or more coupling protrusions are configured to pass through one or more recess parts defined in upper and lower sides of each of the guide slots.

13. The basket according to claim 9, wherein each of the pair of guide members includes a plurality of contact protrusions that protrude to contact the outer surface of the first or second wall of the basket body.

14. A basket for a refrigerator comprising:

a basket body having a receiving space therein for storing food, the receiving space formed by a plurality of walls including a first wall and a second wall facing the first wall;

a partition member disposed in the receiving space to partition the receiving space of the basket body;

a pair of guide slots respectively defined in the first and second walls of the basket body and formed lengthwise in a direction in which the partition is movable, the pair of guide slots configured to guide movement of the partition member;

a pair of guide members disposed on respective outer surfaces of the first and second walls, the guide members being coupled to the partition member through the guide slots, wherein an inner bracket and an outer bracket are coupled to the first and second walls at each of the guide slots, and a slot having a length corresponding to the guide slot is defined in each of the inner bracket and the outer bracket to allow a portion of the guide member to pass through the guide slot and the slot.

15. The basket according to claim 14, wherein the guide member includes a recess to accommodate the outer bracket.

16. The basket according to claim 14, wherein contact protrusions are arranged along upper and lower portions of the outer bracket and protrudes to contact the outer surface of the basket such that the outer bracket is spaced a prescribed distance from the wall.

17. The basket according to claim 14, wherein a coupling protrusion which passes through a recess part defined in each of upper and lower sides of each of the guide slots is provided on the inner bracket, and a coupling groove that is coupled to the coupling protrusion is provided on the outer bracket.

* * * * *